US008746842B2

(12) United States Patent
Tachibana

(10) Patent No.: US 8,746,842 B2
(45) Date of Patent: Jun. 10, 2014

(54) IMAGE FORMING APPARATUS

(75) Inventor: Eiji Tachibana, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/369,383

(22) Filed: Feb. 9, 2012

(65) Prior Publication Data

US 2012/0212543 A1 Aug. 23, 2012

(30) Foreign Application Priority Data

Feb. 21, 2011 (JP) ..... 2011-034939

(51) Int. Cl.
*B41J 23/00* (2006.01)

(52) U.S. Cl.
USPC ..... 347/37

(58) Field of Classification Search
USPC ..... 347/19, 37
See application file for complete search history.

(56) References Cited

U.S. PATENT DOCUMENTS

| | | | | |
|---|---|---|---|---|
| 6,250,735 | B1 * | 6/2001 | Kaneko et al. | 347/19 |
| 6,264,303 | B1 * | 7/2001 | Watanabe | 347/37 |
| 6,601,944 | B1 * | 8/2003 | Kawazoe | 347/37 |
| 7,387,360 | B2 * | 6/2008 | Ohashi | 347/37 |
| 2006/0146106 | A1 | 7/2006 | Naruse | |
| 2007/0097166 | A1 * | 5/2007 | Nakata et al. | 347/19 |
| 2011/0227999 | A1 | 9/2011 | Tachibana | |

FOREIGN PATENT DOCUMENTS

| | | |
|---|---|---|
| JP | 2006-187905 | 7/2006 |
| JP | 2007-105891 | 4/2007 |
| JP | 2010-756 | 1/2010 |

OTHER PUBLICATIONS

Chinese official action dated Jan. 10, 2014 in corresponding Chinese patent application No. 2012 10 03 9651.2.

* cited by examiner

*Primary Examiner* — Alessandro Amari
*Assistant Examiner* — Michael Konczal
(74) *Attorney, Agent, or Firm* — Cooper & Dunham LLP

(57) ABSTRACT

An image forming apparatus includes: a print head to form an image on a recording medium; a carriage, including the print head, which scans in a main scanning direction; a linear encoder scale with scale marks and elongated in the carriage moving direction to detect a position of the carriage; an encoder sensor disposed on a side wall of the carriage including a groove with an upper open concave-shaped cross-section if seen from the carriage moving direction and reads scale marks on the linear encoder scale by passing the linear encoder scale through the groove; and a through-hole forming member, disposed on the side wall of the carriage, configured to cover the encoder sensor, and forming a through-hole extending in the carriage moving direction which the linear encoder scale is passed through. The through-hole forming member is disposed openable with respect to the carriage.

9 Claims, 7 Drawing Sheets

IMAGE FORMING APPARATUS

CROSS-REFERENCE TO RELATED APPLICATION

The present application claims priority from Japanese patent application number 2011-034939, filed on Feb. 21, 2011, the entire contents of which are incorporated by reference herein.

BACKGROUND OF THE INVENTION

1. Field of the Invention

The present invention relates to an image forming apparatus employing inkjet printing.

2. Description of the Related Art

As an image forming apparatus such as a printer, a facsimile machine, a copier, a plotter, and a multifunction apparatus combining several of the capabilities of the above devices, for example, an inkjet recording apparatus including an ink droplet discharge head to impact ink droplets and form images on a medium while conveying the medium by adhering the ink droplets to, for example, a sheet, is known.

Such an image forming apparatus employing the droplet discharge recording method includes a serial-type inkjet printer, which performs printing while scanning the print head by a carriage unit in a direction perpendicular to a sheet conveyance direction, i.e., in a main scanning direction. For a serial-type inkjet printer to perform printing properly, a device to detect a position of the carriage and its extent of movement is necessary. For example, JP-2006-187905A discloses a method using an elongated linear encoder scale in the carriage shifting direction.

FIG. 9 shows a carriage 1 of a known inkjet printer with a linear encoder scale 7. The linear encoder scale 7 generally includes scale marks at an interval of 150 dpi or more. An encoder sensor 8 disposed on the carriage 1 counts the scale marks, thereby controlling the position of the carriage 1. That the linear encoder scale 7 is positioned in the vicinity of the carriage 1 is preferable for precise control of the position of the carriage 1.

However, disposing the linear encoder scale 7 near the carriage 1 causes a problem in that a user contacts the encoder scale inadvertently and possibly damages it, sheet powder from the paper medium attaches to the encoder scale to smear it, or ink mist as a by-product of the ink droplets is generated and the fine ink droplets coat the surface of the linear encoder scale. If the linear encoder scale 7 is damaged or smeared, the encoder sensor 8 cannot correctly count the scale marks and the position of the carriage 1 cannot be controlled correctly. Accordingly, the linear encoder scale has been designed to be replaceable.

The carriage 1 as illustrated in FIG. 9 reads the scale marks drawn on the linear encoder scale 7 with use of the encoder sensor 8. The encoder sensor 8 includes a light emitter and a light receiver disposed opposite each other with a certain interval therebetween. By passing through the linear encode scale 7 between the light emitter and the light receiver, the encoder scale 8 reads the scale marks. Specifically, the encode sensor 8 has a concave-shaped cross-section if seen from the carriage moving direction, with one open end. The concave-shaped portion includes a slit 81, through which the linear encoder scale 7 is passed. Accordingly, because one end of the slit 81 of the encoder sensor 8 is open, when the user erroneously contacts the linear encoder scale 7, the linear encoder scale 7 detaches from the encoder sensor 8 through an opening of the slit 81. If the linear encoder scale 7 detaches from the encoder sensor 8, the linear encoder scale 7 cannot be read by the encoder sensor 8 and the position of the carriage 1 cannot be controlled.

As a countermeasure, a hole can be provided in a side surface of the carriage for preventing the linear encoder scale from detaching. The linear encoder scale is passed through both the detachment prevention hole and the slit of the encoder scale. With this structure, because the linear encoder scale is supported by an inner wall of the detachment prevention hole in the side surface of the carriage, the linear encoder scale does not easily detach from the encoder sensor.

However, because the linear encoder scale needs to be laterally inserted into the detachment prevention hole on the carriage side surface, the detachment prevention hole cannot be easily observed by human eyes and mounting the long encoder scale to the detachment prevention hole is difficult.

BRIEF SUMMARY OF THE INVENTION

The present invention was created to solve the above problem and provides an image forming apparatus that facilitates mounting of the linear encoder scale.

The present invention provides an image forming apparatus including an openable through-hole forming member with respect to the carriage. Therefore, the section with concave-shaped cross-section of the encoder sensor if observed from the carriage moving direction can be exposed. With this structure, the through-hole forming member can be open with respect to the carriage and the linear encoder scale can be mounted to the encoder sensor through the open concave-shaped portion thus exposed, facilitating mounting the through-hole.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

Hereinafter, preferred embodiments of the present invention will now be described with reference to accompanying drawings.

In the present description, the medium may be referred to as "sheet" but not limited thereto, and includes a recorded medium, recording medium, transfer medium, recording sheet, and the like. The image forming apparatus means an apparatus to perform image formation by impacting ink droplets to various media such as paper, thread, fiber, fabric, leather, metals, plastics, glass, wood, ceramics, and the like. "Image formation" means not only forming images with text or graphics having meaning but also forming images without intrinsic meaning such as patterns (and simply impacting the droplets to the medium). Similarly, the term "ink" is not limited thereto but used as an inclusive term for every type of printable liquid, including DNA samples, registration and pattern materials, etc.

Figure 2:
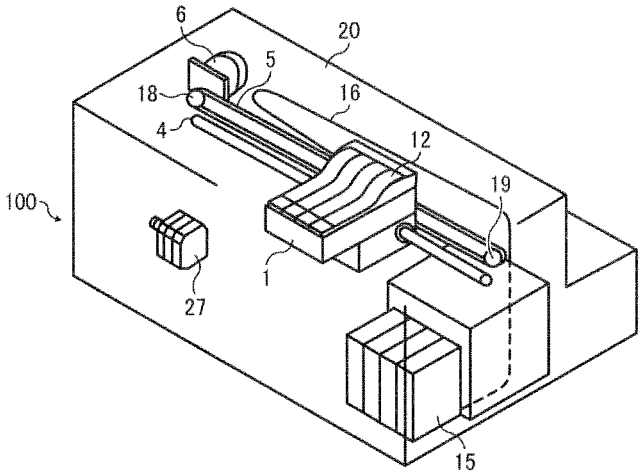
FIG. 2 is an oblique view illustrating an inkjet printer as an example of the image forming apparatus to which the present invention is applied.
Figure 3:
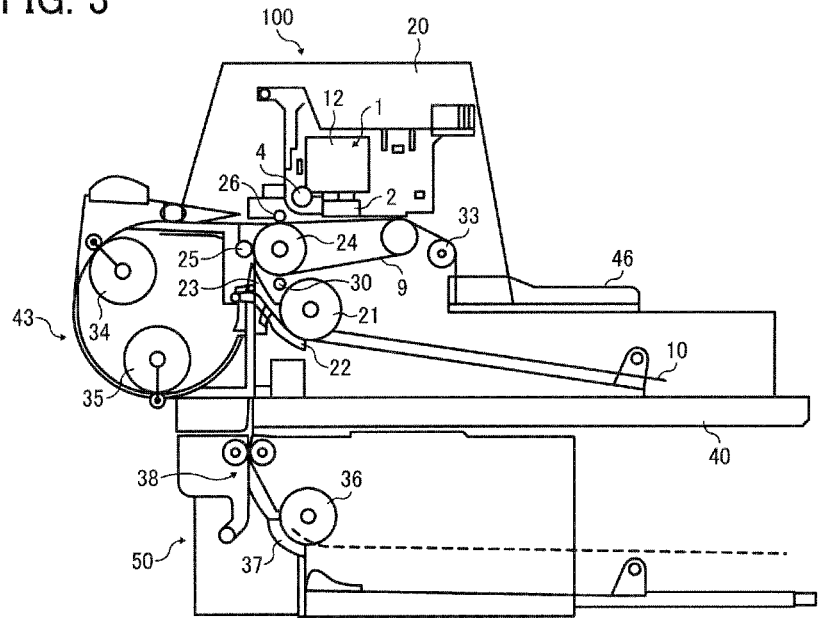
FIG. 3 is a side view illustrating a schematic configuration of the inkjet printer.

FIG. 2 is a perspective view illustrating an inkjet printer as an example of an image forming apparatus to which the present invention is applied. FIG. 3 is a side view illustrating a mechanical section of the inkjet printer in FIG. 2. As illustrated in FIGS. 2 and 3, the inkjet printer includes a printer body 100. The printer body 100 includes a print section 20 that includes a carriage 1, a print head 2 mounted on the carriage 1, a sub tank 12, and the like. The carriage 1 moves in a main scanning direction. The sub tank 12 supplies ink to the print head 2. Below the printer body 100, a sheet cassette or tray 40 is detachably attached from a front side in the figure. The sheet feed cassette 40 may contain a stack of sheets of paper 10. The sheet 10 is conveyed from the sheet cassette 40 to the print section 20 in which predetermined images are recorded, and is discharged onto a sheet discharge tray 46 attached to a rear side of the printer body 100.

The print section 20 further includes a guide rod 4 installed at lateral side plates and configured to support the carriage 1 so that the carriage 1 slidably moves in the main scanning direction (which is a direction perpendicular to the conveyance direction of the sheet 10 in FIG. 3). A print head 2 includes inkjet heads configured to discharge ink droplets of respective colors of yellow (Y), cyan (C), magenta (M), and black (Bk). The print head 2 is mounted to the carriage 1 with its inkjet heads to discharge ink droplets facing down. Respective sub-tanks 12 to supply ink of respective colors to the print head 2 are disposed above the carriage 1.

The sub-tanks 12 of respective colors each are communicated with ink tanks 15 of respective colors via an ink supply tube 16 and are supplied with ink. The ink tanks 15 are replaceable. The carriage 1 slidably engages the guide rod 4 at a rear side of the carriage (downstream in the sheet conveyance direction). A main scanning motor 6 drives to rotate a drive pulley 18 and a driven pulley 19, and a timing belt 5 is stretched over the pulleys 18 and 19. The timing belt 5 is fixed to the carriage 1 so that the carriage 1 moves and scans in the main scanning direction.

To convey the sheet 10 placed in the sheet cassette 40 toward a position below the print head 2, the printer section 20 further includes a sheet feed roller 21 and a friction pad 22, both to separate and convey the sheet 10 from the sheet cassette 40 one by one, a guide member 23 to guide the sheet 10, a conveyance roller 24 to convey the sheet 10 while reversing it, another conveyance roller 25 to be pressed against a peripheral surface of the conveyance roller 24, and a front end roller 26 to define a conveyance angle of the sheet 10 from the conveyance roller 24. The conveyance roller 24 is driven to rotate by a sub scanning motor 27 via a gear train.

Further, a conveyance belt 9 corresponding to the moving range of the carriage 1 in the main scanning direction is disposed to guide the sheet 10 conveyed from the conveyance roller 24 at a side below the print head 2. The sheet 10 is charged by a charger 30. The conveyance belt 9 attracts the charged sheet 10 conveyed thereto and serves to remain the sheet surface to be in parallel with the print head. A sheet discharge roller 33 configured to send the sheet 10 to the sheet discharge tray 46 is disposed downstream of the sheet conveyance direction of the conveyance belt 9.

In addition, the printer body 100 may further include a sheet reverse unit 43 and a sheet feed unit 50 as options. The sheet reverse unit 43 includes a secondary conveyance roller 34 and a third conveyance roller 35. After the print head 2 forms images on the first surface of the sheet 10, the conveyance roller 24 is reversed so that the sheet 10 is pulled inside the printer body 100, the second conveyance roller 34 and the third conveyance roller 35 disposed inside the sheet reverse unit 43 convey the sheet 10 while reversing it to the conveyance roller 24. Then, the sheet 10 is conveyed below the print head 2 with its second surface faced toward the print head 2 and the print head 2 forms images on the second surface of the sheet 10. The sheet feed unit 50 includes a second sheet feed roller 36, a friction pad 37, a sending-out roller 38, and the like, and contains a lot of paper of the same or different size as the sheet feed cassette 40 contains. The paper can be selected from either the sheet feed cassette 40 or the sheet feed unit 50.

Figure 4:
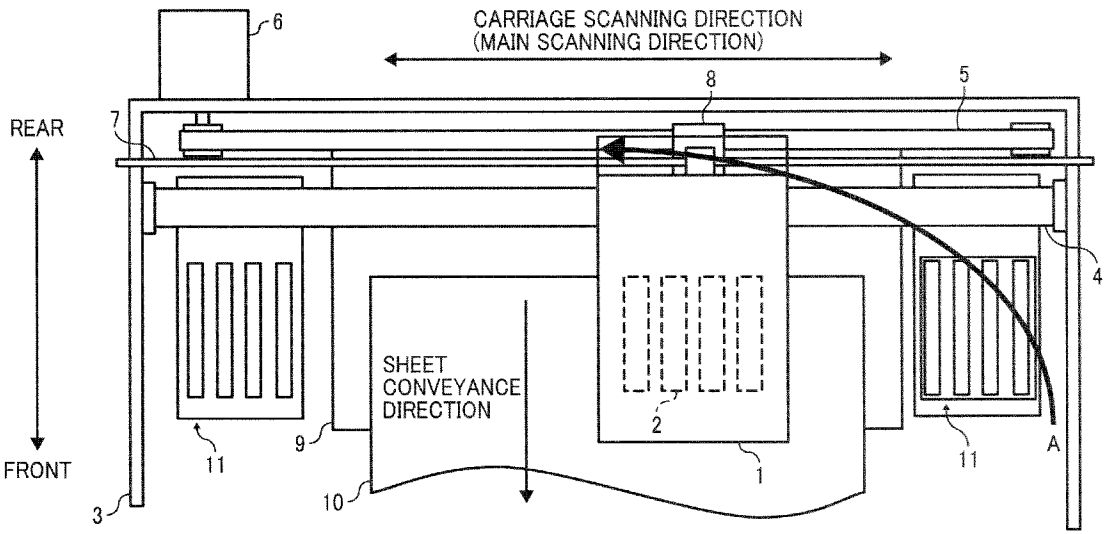
FIG. 4 is a plan view of a serial-type inkjet printer.
Figure 5:
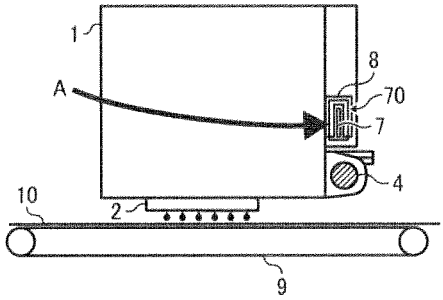
FIG. 5 is a lateral side view of a serial-type carriage.

FIG. 4 is a perspective view illustrating the inkjet printer (hereinafter, "printer") of serial type seen from above according to an embodiment of the present invention. FIG. 5 is a perspective view illustrating the carriage 1 for use in the printer according to an embodiment of the present invention.

The carriage 1 includes a plurality of print heads 2 each configured to discharge ink droplets. The endless timing belt 5 is mounted on the carriage 1 and the timing belt 5 is rotatably driven by the main scanning motor 6, so that the carriage 1 moves along the guide rod 4 in the main scanning direction. At the same time, an encoder sensor 8 disposed at the carriage 1 reads the scale marks of the linear encoder scale 7 elongated in the carriage moving direction and disposed at least in the scanning range of the main scanning direction of the carriage 1 so that the scanned position of the carriage 1 can be detected. Then, each time the sheet 10 is conveyed by the conveyance belt 9 in the sub-scanning direction by a certain constant length, the carriage 1 is being scanned and the print head 2 discharges the ink to form an image on the sheet 10. The linear encoder scale 7 is disposed in the vicinity of the carriage 1 so that the encoder sensor 8 can read the scale marks on the scale 7. In addition, the linear encoder scale 7 is exposed along the range scanned by the carriage 1.

The encoder sensor 8 includes the slit 81 which is a groove to pass through the linear encoder scale 7. In the slit 81 are a light emitter and a light receiver each disposed on opposite surfaces inside the slit 8 with a predetermined distance therebetween. The linear encoder scale 7 is passed through between the light emitter and the light receiver, so that the encoder sensor 8 reads the scale marks on the linear encoder scale 7, thereby detecting a position of the carriage 1.

Although the linear encoder scale 7 is illustrated to have a certain thickness to facilitate understanding of the structure, the linear encoder scale 7 is in general formed of a transparent film member on which scale marks are printed. The encoder sensor 8 counts the scale marks on the linear encoder scale 7 by using non-transparent portions on which scale marks are printed and transparent portions on which scale marks are not printed.

As described above, the scale marks on the linear encoder scale 7 are read by the encoder sensor 8. The encoder sensor 8 includes the light emitter and the light receiver disposed with a certain distance therebetween, through which the linear encoder scale 7 is passed, thereby reading the scale marks. Specifically, the encoder sensor 8 has a concave-shaped cross-section with an upper open end if seen from the carriage moving direction. The concave-shaped portion is the slit 81 and the linear encoder scale 7 is passed through the slit 81.

Accordingly, because the upper end of the slit 81 of the encoder sensor 8 is open, when the user inadvertently contacts the linear encoder scale 7, the linear encoder scale 81 detaches from the encoder sensor 8 through the opening of the slit 81. Accordingly, in the present embodiment, a hole for preventing the linear encoder scale 7 from coming off is provided on a side surface of the carriage 1. The linear encoder scale 7 is passed through both the detachment prevention hole and the slit 81 of the encoder scale 8. With this structure, because the linear encoder scale 7 is supported by an inner wall of the detachment prevention hole disposed on the carriage 1, the linear encoder scale 7 does not easily detach from the encoder sensor 8 even though the user mistakenly contacts the linear encoder scale 7.

In order to pass the linear encoder scale 7 through the slit 81 of the encoder sensor 8, the linear encoder scale 7 can be laterally inserted into the encoder sensor 8 from the carriage 1 disposed at a front as illustrated by an arrow A in FIG. 4. However, the encoder sensor 8 preferably is disposed near the guide rod 4 or the timing belt 5 for the capability of correct control of the carriage 1 and less possibility of the contact by humans, and the encoder sensor 8 is in many cases mounted at the rear of the carriage 1 as illustrated in FIG. 5. Because a frame member 3 and others are disposed in the lateral sides of the carriage 1, the user usually performs replacement of the linear encoder scale 7 from a front side of the carriage 1 without observing the encoder sensor 8 hidden by the carriage 1 and the like.

First Embodiment

Figure 1A:
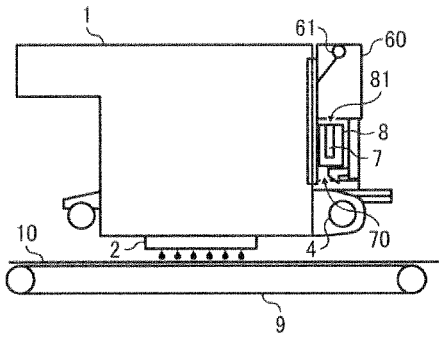
FIGS. 1A and 1B are schematic views of a carriage according to a first embodiment of the present invention with a sensor cover in closed and open positions, respectively.
Figure 1B:
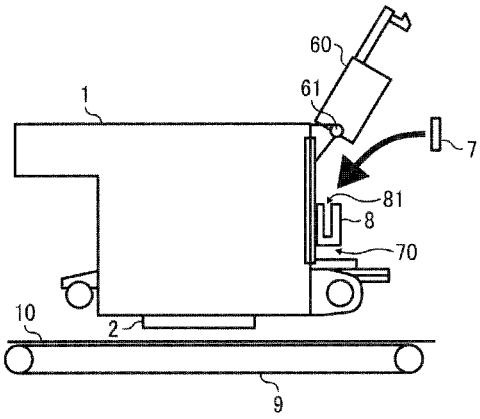

FIGS. 1A and 1B are schematic views of a carriage according to a first embodiment of the present invention, with a sensor cover in closed and open positions, respectively.

A detachment prevention hole 70 is a through-hole configured to extend in the carriage moving direction in which the linear encoder scale 7 passes through and to prevent the linear encoder scale 7 from detaching from the encoder sensor 8. In the present embodiment, a sensor cover 60 configured to cover the encoder sensor 8 and serving as a through-hole forming member along with the side surface of the carriage 1 is disposed as a detachment prevention hole 70. The sensor cover 60 is rotatable about a hinge 61 serving as a rotation shaft and is openable with respect to the carriage 1.

During the normal printing operation, as illustrated in FIG. 1A, the sensor cover 60 is closed with respect to the carriage 1 so that even though the user mistakenly contacts the linear encoder scale 7, the linear encoder scale 7 is supported by the inner wall of the detachment prevention hole 70 of the carriage 1, so that the linear encoder scale 7 is prevented from detaching from the encoder sensor 8 easily.

By contrast, when the linear encoder scale 7 is to be replaced, the sensor cover 60 is rotated counterclockwise to be open with respect to the carriage 1 as illustrated in FIG. 1B and the detachment prevention hole 70 is exposed to be open. With this structure, an upper open portion of the slit 81 of the encoder sensor 8 with a concave cross section seen from the carriage moving direction can be exposed and the linear encoder scale 7 can be mounted to the encoder sensor 8 from the upper open part. Accordingly, because even in a case where the user replaces the linear encoder scale 7 from a front side, the linear encoder scale 7 can be mounted to the upper open concave-shaped slit 81, the workability is improved than in a case where the linear encoder scale 7 is inserted into the slit 81 of the encoder sensor 8 via the detachment prevention hole 70 laterally from the carriage 1.

In this case, because mounting the linear encoder scale 7 to the encoder sensor 8 is easier from above the encoder sensor 8, the slit 81 of the encoder sensor 8 is preferably formed to be an upper open concave-shaped cross-section (upside open slit) if seen from the carriage moving direction.

Second Embodiment

Figure 6A:
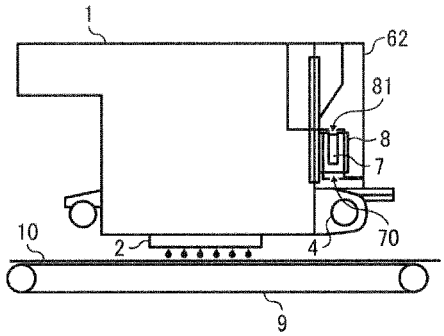
FIGS. 6A and 6B are schematic views of a carriage according to a second embodiment of the present invention.
Figure 6B:
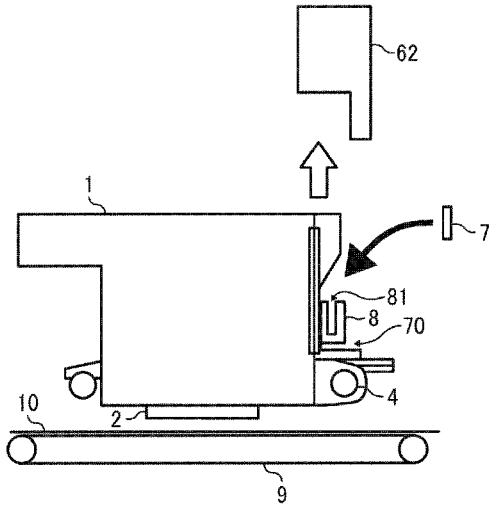

FIGS. 6A and 6B are schematic views of a carriage according to a second embodiment of the present invention.

The detachment prevention hole 70 is a through-hole configured to extend in the carriage moving direction in which the linear encoder scale 7 passes through and to prevent the linear encoder scale 7 from detaching from the encoder sensor 8. In the present embodiment, a sensor cover 62 configured to cover the encoder sensor 8 and serving as a through-hole forming member along with the side surface of the carriage 1 is detachably disposed to the carriage 1.

During the normal printing operation, the sensor cover 62 is attached to the carriage 1 as illustrated in FIG. 6A. Even though the user mistakenly contacts the linear encoder scale 7, the linear encoder scale 7 is supported by the inner wall of the detachment prevention hole 70 of the carriage 1 so that the linear encoder scale 7 is prevented from detaching from the encoder sensor 8 easily.

By contrast, when the linear encoder scale 7 is to be replaced, the sensor cover 62 is lifted upwards and is removed as illustrated in FIG. 6B so that the detachment prevention hole 70 is exposed. With this structure, an upper opening of the slit 81 of the encoder sensor 8 with a concave cross section seen from the carriage moving direction can be exposed and the linear encoder scale 7 can be mounted to the encoder sensor 8 from the upper opening. Accordingly, because even in a case where the user replaces the linear encoder scale 7 from a front side, the linear encoder scale 7 can be mounted to the upper open concave-shaped slit 81, the workability is improved than in a case where the linear encoder scale 7 is inserted into the slit 81 of the encoder sensor 8 via the detachment prevention hole 70 laterally from the carriage 1.

In addition, because the sensor cover 62 is detachably attachable to the carriage 1, more freeness in accessing the detachment prevention hole 70 is achieved.

Third Embodiment

Figure 7A:
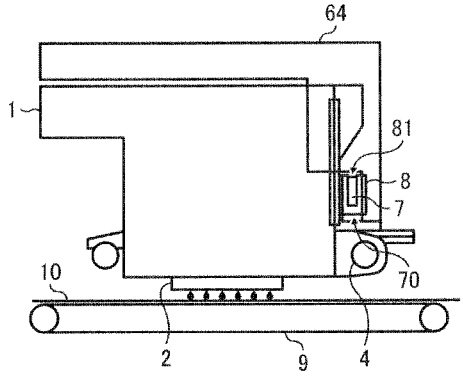
FIGS. 7A and 7B are schematic views of a carriage according to a third embodiment of the present invention.
Figure 7B:
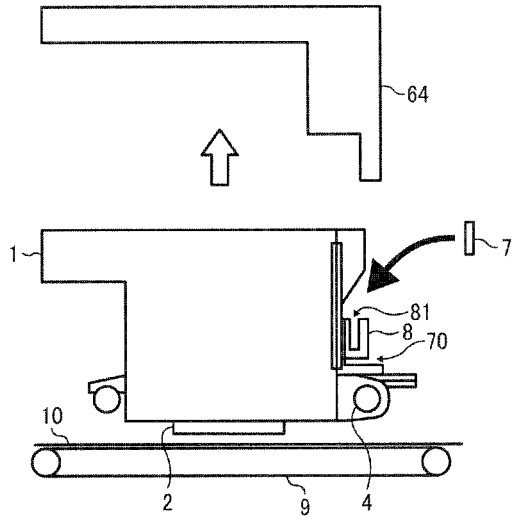

FIGS. 7A and 7B are schematic views of a carriage according to a third embodiment of the present invention.

In general, a carriage cover is detachably attached to the carriage 1 for the replacement and maintenance of the parts inside the carriage 1. When a sensor cover 64 detachably disposed to the carriage 1 and configured to form the detachment prevention hole 70 of the linear encoder scale 7 along with the side wall of the carriage 1 as a through-hole forming member is concurrently used as a carriage cover, the number of parts or devices to detach and attach the cover can be decreased and the manufacturing cost can be reduced.

The user is not expected to uncover the carriage cover from its original purpose and the serviceperson uncovers it for the replacement of parts and maintenance services. Therefore, there is no problem in removing the carriage cover at the same time when the linear encoder scale 7 is replaced by the serviceperson.

Although the first embodiment shows a case in which the sensor cover is openable by rotating it about the rotating shaft, the sensor cover and the carriage cover can be commonly used in the first embodiment similarly to the second embodiment and the same effect can be obtained.

Modified Embodiment

Figure 8A:
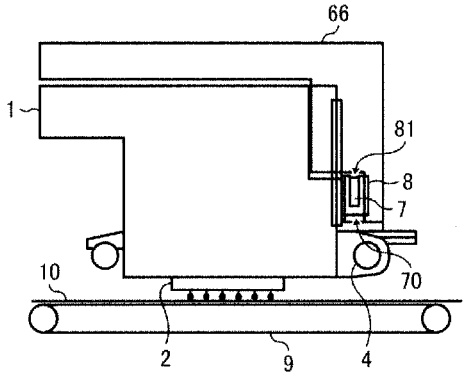
FIGS. 8A and 8B are schematic views of a carriage according to a variation of the present invention.
Figure 8B:
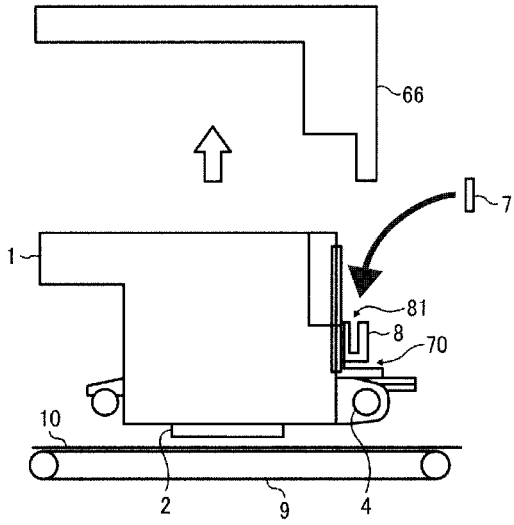
Figure 9:
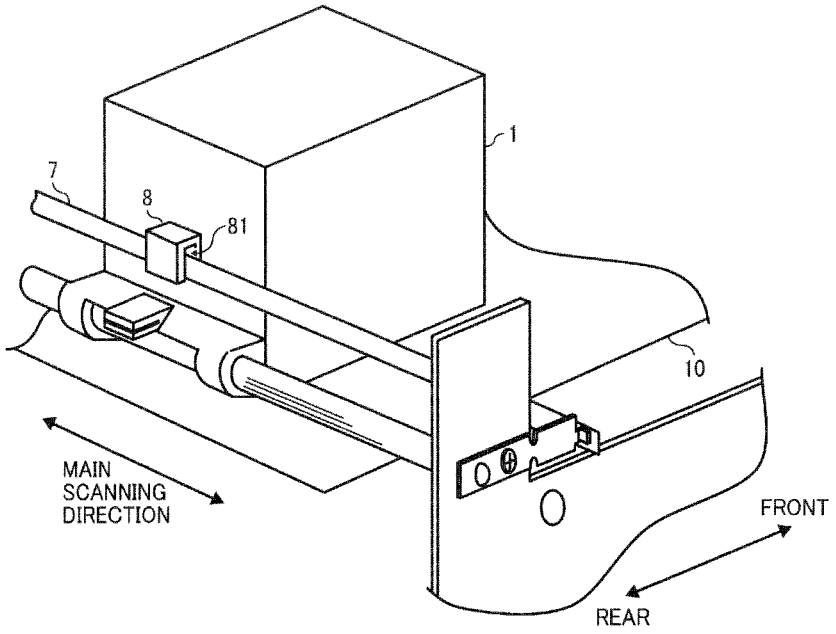
FIG. 9 BACKGROUND ART
FIG. 9 is an oblique view illustrating a carriage of a known inkjet printer.

A board disposed on the carriage 1 and to which the encoder sensor 8 is fixed includes mostly a device to transmit a signal to the carriage 1. To facilitate maintenance of the board on which the encoder sensor 8 is fixed, a sensor cover 66 concurrently serving as a carriage cover is preferably removable from the carriage 1 so as to allow an access to the board as illustrated in FIGS. 8A and 8B.

As aforementioned, the image forming apparatus according to the embodiment of the present invention includes: a print head 2 to form an image on a sheet of paper 10; a carriage 1 including the print head 2 and configured to scan in the main scanning direction; a linear encoder scale 7 with scale marks and elongated in the carriage moving direction to detect a position of the carriage 1; an encoder sensor 8 disposed on a side wall of the carriage 1 including a slit 81 with an upper open end having a concave-shaped cross-section if seen from the carriage moving direction, and the encoder sensor 8 configured to read the scale marks of the linear encoder scale 7 by passing the linear encoder scale 7 through the slit 81; and a sensor cover disposed on the side wall of the carriage 1, configured to cover the encoder sensor 8 and serving as a through-hole forming member to form a detachment prevention hole 70 being a through-hole extending in the carriage moving direction in which the linear encoder scale 7 is passed through. The sensor cover is disposed openable with respect to the carriage 1. As aforementioned, because the sensor cover is openable with respect to the carriage 1, when the sensor cover is open, the detachment prevention hole 70 is exposed and the concave-shaped open portion of the slit 81 of the encoder sensor 8 can be open and exposed. With this structure, the sensor cover is open with respect to the carriage 1 and the detachment prevention hole 70 is exposed, and the linear encoder scale 7 can be mounted to the encoder sensor 8 from the concave-shaped open portion exposed of the slit 81. With this structure, the workability can be improved compared to the case in which the linear encoder scale 7 is inserted into the slit 81 of the encoder sensor 8 by inserting the linear encoder scale 7 into the detachment prevention hole 70 from a lateral side of the carriage 1.

Further, according to the embodiment of the present invention, a hinge 61 serving as a rotation shaft to rotatably support the sensor cover with respect to the carriage 1 is provided so that the sensor cover 60 is rotatable about the hinge 61 to be open with respect to the carriage 1 and to expose the detachment prevention hole 70 to outside.

Further, according to the embodiment of the present invention, the sensor cover 62, 64, or 66 is detachably attached to the carriage 1. Therefore, without disposing a part such as a hinge, the sensor cover 62, 64, or 66 can de removed from the carriage 1 and the detachment prevention hole 70 can be exposed.

Furthermore, according to the embodiment of the present invention, the sensor cover 64 or 66 concurrently serves as a carriage cover to cover the inside the carriage. Thus, by integrally forming the sensor cover and the carriage cover, the number of parts and devices for attach- and detachment of the cover may be reduced, and the cost reduction can be achieved.

Further, the slit 81 of encoder sensor 8 has a concave-shaped cross-section with an upper open end if seen from the carriage moving direction. Because mounting the linear encoder scale 7 to the encoder sensor 8 is easier from above, the slit 81 of the encoder sensor 8 preferably has an upper open concave-shaped cross-section.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a print head to form an image on a recording medium;

a movable carriage including the print head and configured to scan reciprocally in a main scanning direction;

a linear encoder scale bearing scale marks therein on a surface thereof, extending in a direction of movement of the carriage to detect the position of the carriage;

an encoder sensor disposed on a side wall of the carriage and having a groove therein with an open concave shape in cross-section, the encoder sensor reading the scale marks on the linear encoder scale as the linear encoder scale passes through the groove; and a through-hole forming member disposed on the side wall of the carriage configured to cover the encoder sensor, and forming a through-hole extending in the carriage moving direction through which the linear encoder scale is passed, wherein the through-hole forming member is detachably attachable with respect to the carriage.

2. The image forming apparatus as claimed in claim 1, further comprising a shaft member configured to rotatably support the through-hole forming member with respect to the carriage, wherein the through-hole forming member is openably closable with respect to the carriage.

3. The image forming apparatus as claimed in claim 1, wherein the through-hole forming member is a cover configured to cover the interior of the carriage.

4. The image forming apparatus as claimed in claim 1, wherein the groove of the encoder sensor has an upwardly open concave-shaped cross-section if seen from the carriage moving direction.

5. The image forming apparatus as claimed in claim 1, wherein the encoder sensor comprises a light emitter and a light receiver each disposed on opposite surfaces inside the slit.

6. An image forming apparatus comprising:

a print head to form an image on a recording medium;

a movable carriage including configured to scan reciprocally in a main scanning direction, the print head being removably mounted on the carriage;

a linear encoder scale bearing scale marks therein on a surface thereof, extending in a direction of movement of the carriage to detect the position of the carriage;

an encoder sensor disposed on a side wall of the carriage and having a groove therein with an open concave shape in cross-section, the encoder sensor reading the scale marks on the linear encoder scale as the linear encoder scale passes through the groove; and a through-hole forming member disposed on the side wall of the carriage, and forming a through-hole extending in the carriage moving direction through which the linear encoder scale is passed, wherein the through-hole forming member is detachably attachable with respect to the carriage.

7. The image forming apparatus as claimed in claim 6, wherein the through-hole forming member is a cover configured to cover the interior of the carriage.

8. The image forming apparatus as claimed in claim 6, wherein the groove of the encoder sensor has an upwardly open concave-shaped cross-section viewed from the carriage moving direction.

9. The image forming apparatus as claimed in claim 6, wherein the encoder sensor comprises a light emitter and a light receiver each disposed on opposite surfaces inside the slit.

* * * * *